US005450055A

United States Patent [19]

Doi

[11] Patent Number: 5,450,055

[45] Date of Patent: Sep. 12, 1995

[54] METHOD OF MAKING CHIP RESISTORS

[75] Inventor: Masato Doi, Kyoto, Japan

[73] Assignee: Rohm Co., Ltd., Kyoto, Japan

[21] Appl. No.: 111,936

[22] Filed: Aug. 26, 1993

[30] Foreign Application Priority Data

Aug. 28, 1992 [JP] Japan ..... 4-230376

[51] Int. Cl.[6] ..... H01C 1/148

[52] U.S. Cl. ..... 338/332; 338/309

[58] Field of Search ..... 338/332, 307–309, 338/321–323, 328, 227, 230, 330, 327; 357/65, 68; 437/183, 189

[56] References Cited

U.S. PATENT DOCUMENTS 4,780,702 10/1988 Snel et al. ..... 338/308
4,792,781 12/1988 Takahashi et al. ..... 338/307
4,829,553 5/1989 Shindo et al. ..... 338/309
5,258,728 11/1993 Schat ..... 338/332

FOREIGN PATENT DOCUMENTS 4-102302 4/1992 Japan .

*Primary Examiner*—Bruce A. Reynolds
*Assistant Examiner*—Tu Hoang
*Attorney, Agent, or Firm*—William H. Eilberg

[57] ABSTRACT

A chip resistor is provided which comprises: an electrically insulating substrate chip having a top surface, an opposite pair of end faces, and an opposite pair of side faces; a resistor element formed on the top surface of the chip intermediate the end faces of the chip; a coating for covering the resistor element; a spaced pair of main electrodes formed on the top surface of the chip adjacent to the respective end faces of the chip in conduction with the resistor element; a spaced pair of auxiliary electrodes formed on the respective main electrodes; a pair of end electrodes formed on the respective end faces of the chip in conduction with the main and auxiliary electrodes; and a metallic plating formed on the auxiliary and end electrodes. Each of the main and auxiliary electrodes is spaced inwardly from the respective side faces of the chip.

5 Claims, 6 Drawing Sheets

PRIOR ART

METHOD OF MAKING CHIP RESISTORS

BACKGROUND OF THE INVENTION

1. Field of the Invention

This invention relates to a chip resistor wherein a film-like resistor element is formed on an electrically insulating substrate chip. The present invention also relates to a method of making chip resistors.

2. Description of the Prior Art

The applicant has formerly invented such a chip resistor as disclosed in Japanese Patent Application Laid-open No. 4-102302. For convenience of explanation, the configuration of this known chip resistor is illustrated in FIGS. 12*a*–12*c*.

As shown in FIGS. 12*a*–12*c*, the prior art chip resistor, generally designated by reference numeral 30, comprises an insulating substrate chip 31 made of e.g. ceramic. A film-like resistor element 33 covered by a glass coating 32 is formed on the chip 31 in conduction with a spaced pair of main electrodes 34. An auxiliary electrode 35 is formed on each of the main electrodes 34, and an end electrode 36 is formed on each end face of the chip 31 in conduction with the corresponding main and auxiliary electrodes 34, 35. Further, the auxiliary and end electrodes 35, 36 are covered by an unillustrated plating of e.g. nickel.

According to the prior art, the auxiliary electrode 35 reduces the degree of level difference from the coating 32, thereby increasing the surface flatness of the chip resistor 30 as a whole. Thus, a vacuum collet A (FIG. 12*a*) of an automatic mounting apparatus can still be used for conveniently picking up the chip resistor 30 to mount it onto a circuit board even if the chip resistor 30 comes positionally out of alignment with the collet A.

Further, the increased surface flatness of the resistor chip 30 is also significant in properly mounting the chip 30 on a circuit board B (including a circuit B1) in an inverted state because both of the auxiliary electrodes 35 can be reliably brought into contact with corresponding solder deposits C, as shown in FIG. 12*b*. If, on the other hand, no auxiliary electrode is provided, the resistor chip tends to be unstable so that it is more likely to be mounted improperly (tilted), as shown in FIG. 12*c*.

However, the prior art resistor chip described above still has the following problems.

In an automatic chip mounting apparatus, use is made of a flexible supply tube D which is made of a synthetic resin for example and has a rectangular cross section, as shown in FIG. 12*a*. The resistor chip 30 is loaded into the tube D for transfer and taken out from the tube D at the site of chip mounting for picking up by the vacuum collet A.

According to the prior art arrangement, since each auxiliary electrode 35 extends over the full width of the substrate chip 31, the sharp edges of the electrode 35 tends to be easily caught within the tube D, consequently hindering smooth supply of the chip resistor 30. Particularly, when the auxiliary electrode 35 is covered by a metallic plating (e.g. nickel plating), the plating will have burrs at the edges of the auxiliary electrode 35, thereby increasing the possibility of the chip resistor 30 being caught in the tube D.

SUMMARY OF THE INVENTION

It is, therefore, an object of the present invention to provide a chip resistor which can be smoothly supplied by a chip supply tube for facilitating automatic mounting.

Another object of the present invention to provide a method of making chip resistors which facilitates printing of a resistance indication onto each resistor.

A further object of the present invention is to provide a method of making chip resistors which provides an accurate resistance determination for subsequent printing of a resistance indication.

According to one aspect of the present invention, there is provided a chip resistor comprising: an electrically insulating substrate chip having a top surface, an opposite pair of end faces, and an opposite pair of side faces; a resistor element formed on the top surface of the chip intermediate the end faces of the chip; a coating means for covering the resistor element; a spaced pair of main electrodes formed on the top surface of the chip adjacent to the respective end faces of the chip in conduction with the resistor element; a spaced pair of auxiliary electrodes formed on the respective main electrodes; a pair of end electrodes formed on the respective end faces of the chip in conduction with the main and auxiliary electrodes; and a metallic plating formed on the auxiliary and end electrodes; wherein each of the main and auxiliary electrodes is spaced inwardly from the respective side faces of the chip.

According to another aspect of the present invention, there is provided a method of making resistor chips comprising the steps of: preparing a material substrate having a plurality of column break lines and a plurality of row break lines for providing a plurality of substrate chips and at least one row of dummy chips; forming a spaced pair of main electrodes on each of the substrate chips; forming a resistor element on said each substrate chip to bridge between said pair of main electrodes, the resistor element of said each substrate chip being electrically independent of the resistor element of any other substrate chip in a same column; forming a coating means for covering the resistor element of said each substrate chip; forming a spaced pair of auxiliary electrodes on said pair of main electrodes; dividing the material substrate into substrate columns by breaking at the column break lines, each of the substrate columns having an opposite pair of longitudinal edges; forming a pair of end electrodes on said pair of longitudinal edges of said each substrate column; and dividing said each substrate column into individual substrate chips by breaking at the row break lines; wherein at the time of forming the main electrodes, a spaced pair of dummy electrodes are formed on a selected one of the dummy chips in conduction with the main electrodes of a representative substrate chip which is located closest to the selected dummy chip; before dividing the material substrate into the substrate columns, the resistance of the resistor element of the representative substrate chip is determined by utilizing the pair of dummy electrodes, and a resistance indication is formed on the coating means of said each substrate chip.

In an embodiment of the invention, the resistance of the resistor element of the representative substrate chip may be determined by bringing probes of a resistance meter into direct contact with the pair of dummy electrodes. Obviously, no problem arises even if the dummy electrodes are damaged by direct contact with the probes because the dummy chips are ultimately discarded.

Preferably, the auxiliary electrodes of said each substrate chip are electrically independent of the auxiliary electrodes of any other substrate chip in a same column. In this case, the resistance of the resistor element of the representative substrate chip may be determined after forming the auxiliary electrodes of said each substrate chip, so that the resistance determination is rendered more accurate by taking account of a resistance change which would occur gradually by the successive method steps.

Other objects, features and advantages of the present invention will become apparent from the following detailed description of the preferred embodiments given with reference to the accompanying drawings.

DETAILED DESCRIPTION OF THE PREFERRED EMBODIMENTS

Figure 1:
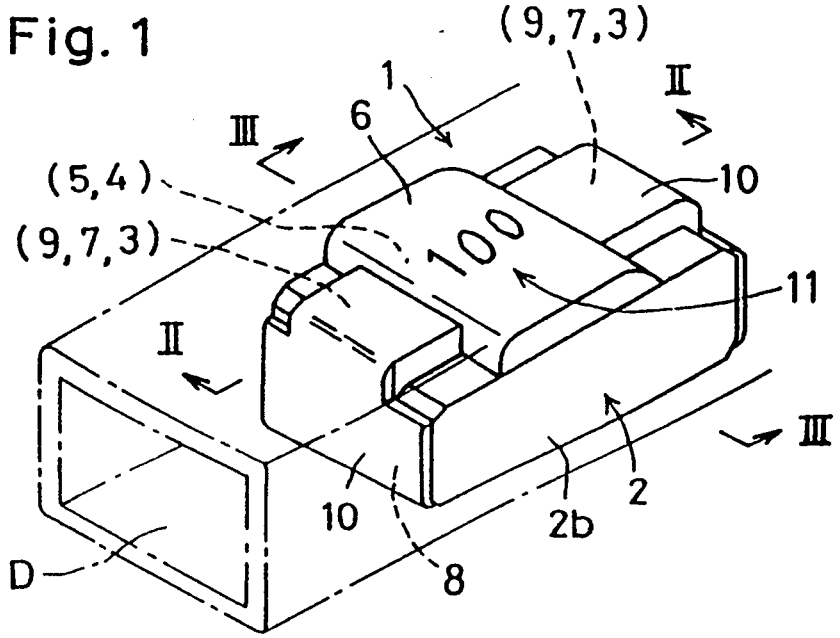
FIG. 1 is a perspective view showing a chip resistor embodying the present invention.
Figure 2:
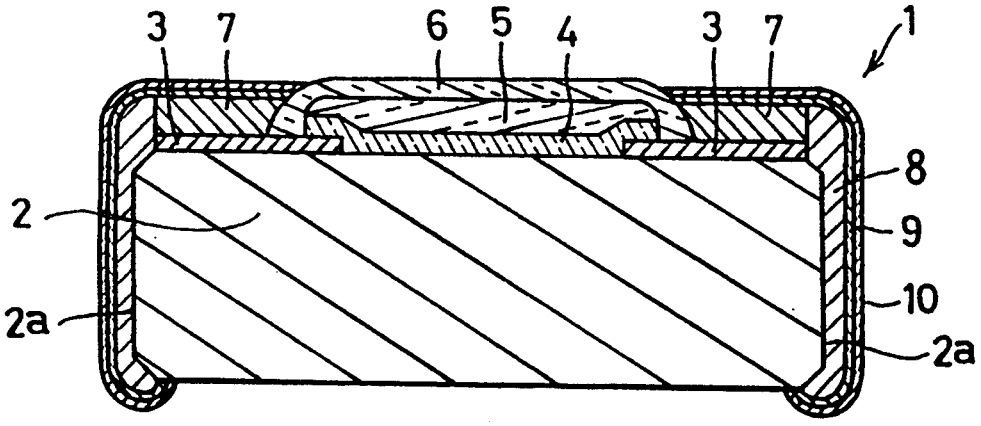
FIG. 2 is a sectional view taken along lines II—II in FIG. 1.
Figure 3:
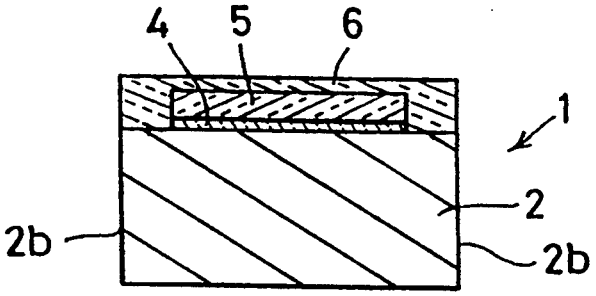
FIG. 3 is a sectional view taken along lines III—III in FIG. 1.

Referring first to FIGS. 1 through 3 of the accompanying drawings, a chip resistor 1 according to an embodiment of the present invention comprises a generally parallelepiped substrate chip 2 which is made of an electrically insulating material such as alumina for example. The substrate chip 2 has a top surface formed with a pair of film-like top main electrodes 3 located adjacent to respective end faces 2*a* (FIG. 2) of the chip. The width of each top main electrode 3 is rendered smaller than that of the chip.

The top surface of the substrate chip 2 is also formed, at its central portion, with a film-like resistor element 4 extending between the respective main electrodes 3. The width of the resistor element 4 is substantially equal to that of the main electrodes 3 but smaller than that of the chip, so that the resistor element 4 is completely located inwardly from opposite side faces 2*b* of the substrate chip 2, as clearly shown in FIG. 3.

The resistor element 4 has a top surface formed with a primary cover coating 5 which may be made of glass for example. The primary cover coating 5 corresponds substantially to the resistor element 4 both in length and width, as clearly shown in FIGS. 2 and 3.

A secondary cover coating 6 is formed to cover the primary cover coating 5. The secondary cover coating 6, which may be also made of glass for example, is made to extend over the entire width of the substrate chip 2, as shown in FIG. 1.

Each of the top main electrodes 3 is covered by a top auxiliary electrode 7. The width of the auxiliary electrode 7 is substantially equal to that of the main electrode 3 (see FIG. 1).

Due to the presence of the auxiliary electrode 7, the degree of step or height difference from the secondary cover coating 6 is greatly reduced when compared with a structure wherein no such auxiliary electrode is provided. In other words, the auxilary electrode 7 improves the surface flatness of the chip resistor 1 as a whole to enable a vacuum collet (not shown) to reliably hold the chip resistor.

Each of the end faces 2*a* of the substrate chip 2 is formed with an end electrode 8 in conduction with the relevant main and auxiliary electrodes 3, 7. The end electrode 8 extends over the entire width of the substrate chip 2, as shown in FIG. 1.

A primary plating 9 is formed to entirely cover each auxiliary electrode 7 and each end electrode 8. Further, the primary plating 9 is entirely covered by a secondary plating 10. The primary plating 9 may be made of nickel for example, whereas the secondary plating 10 may be made of e.g. solder.

The second cover coating 6 may carry an indication 11 which represents the resistance of the chip resistor 1. The indication 11 may be formed by printing for example.

According to the arrangement described above, each of the top auxiliary electrodes 7 is spaced inwardly from the respective side faces 2*b* of the substrate chip 2. Thus, even if the respective platings 9, 10 have burrs at the edges of the auxiliary electrode 7, these burrs will not project beyond the respective side faces 2*b* of the substrate chip 2. As a result, when the chip resistor 1 is loaded into and taken out of a supply tube D (see FIG. 1) for chip mounting, the chip resistor 1 will not be caught in the supply tube, thereby insuring smooth supply of the chip resistor.

According to the illustrated embodiment, each of the end electrodes 8 is made to extend over the entire width of the substrate chip 2. However, the end electrode 8, together with the relevant platings 9, 10, may be spaced inwardly from the respective side faces 2*b* of the chip 2.

The chip resistor 1 may be manufactured by a method shown in FIGS. 4 through 11.

Figure 4:
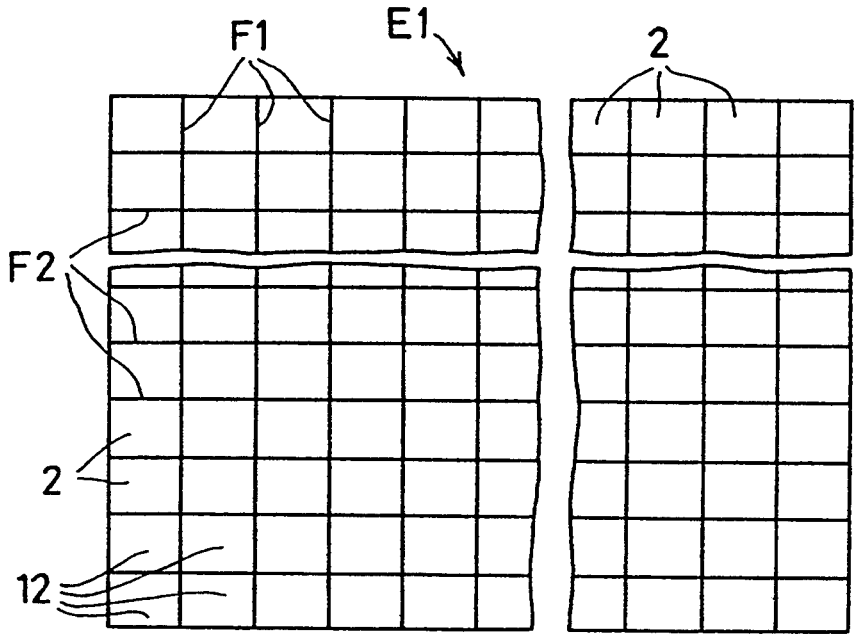
FIG. 4 is a plan view showing a material substrate used in a preferred method for manufacturing a plurality of chip resistors according to the present invention.

A rectangular material substrate E1 having a plurality of column break lines F1 and a plurality of row break lines F2 is first prepared, as shown in FIG. 4. The material substrate E1 provides a plurality of substrate chips 2 defined by the respective break lines F1, F2. The respective break lines F1, F2 may be formed by scribing for example. The material substrate E1 further includes a plurality of dummy chips 12 in two marginal rows. The purpose of providing the dummy chips 12 will be described later.

Figure 5A:
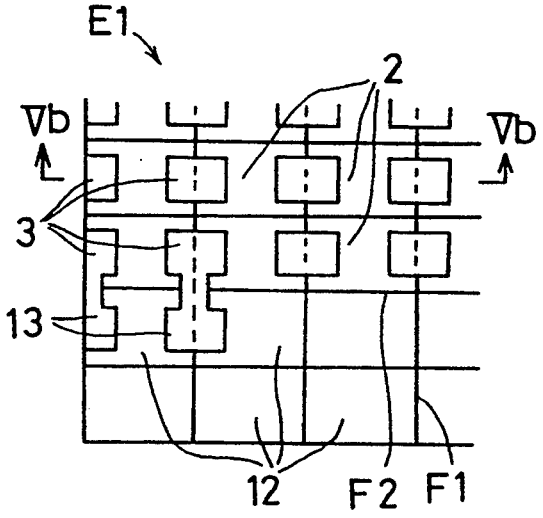
FIG. 5*a* is a fragmentary plan view showing a method step of forming top main electrodes.
Figure 5B:
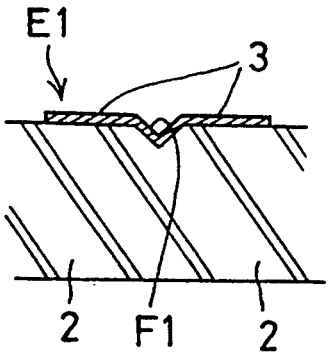
FIG. 5*b* is a sectional view taken along lines Vb—Vb in FIG. 5*a;*

Then, pairs of film-like top main electrodes 3 are formed adjacent to the positions corresponding to the end faces 2*a* (see FIG. 2) of each substrate chip 2 by depositing a suitable conductive paste in a screen printing method, as shown in FIGS. 5*a* and 5*b*. At the same time, a pair of dummy electrodes 13 are formed on a selected dummy chip 12 in electrical conduction with an adjacent pair of main electrodes 3. Note that the screen printing is performed so that the deposited paste material continuously traverses each column break line F1 for simplification of the method, as shown in FIG. 5*b*.

Figure 6A:
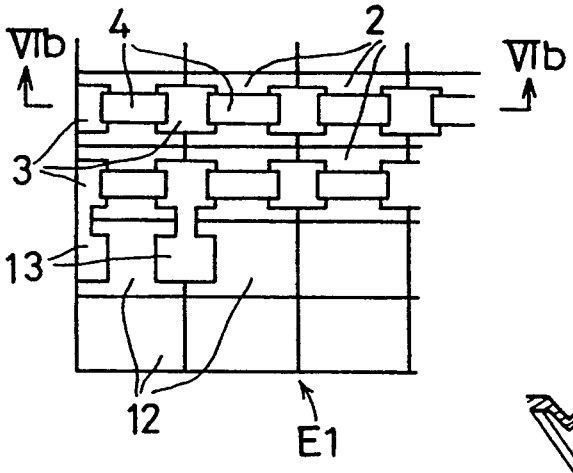
FIG. 6*a* is a fragmentary plan view showing a method step of forming resistor elements.
Figure 6B:
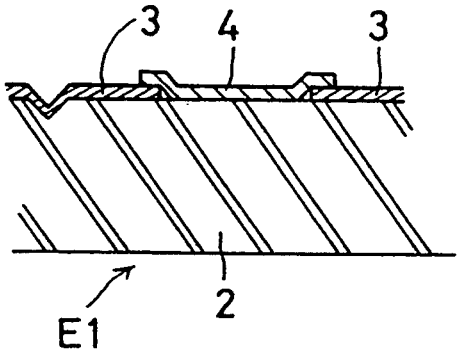
FIG. 6*b* is a sectional view taken along lines VIb—VIb in FIG. 6*a;*

Then, resistor elements 4 are formed by depositing a pasty resistor material in a screen printing method to bridge between the respective pairs of top main electrodes 3, as shown in FIGS. 6*a* and 6*b*.

Then, the material substrate E1 is placed in a heating furnace for curing the respective electrodes 3 and the respective resistor elements 4.

Figure 7:
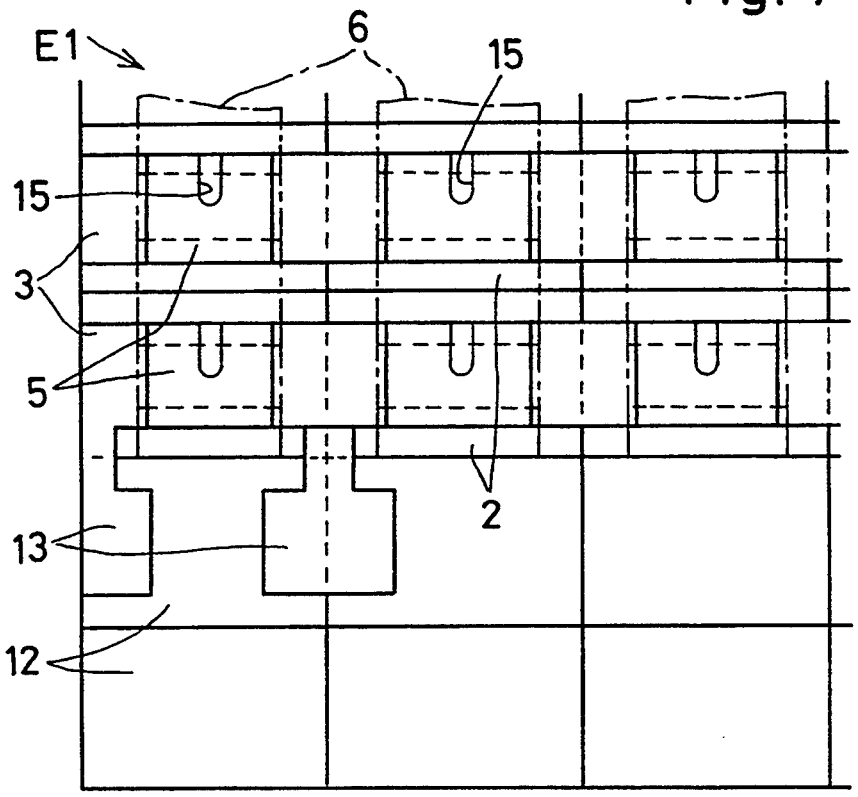
FIG. 7 is a fragmentary plan view showing a method step of forming cover coatings.

Then, a primary cover coating 5 is formed by depositing a Glass paste in a screen printing method to cover each resistor element 4, as shown in FIG. 7. After baking the primary cover coating 5 for curing, a trimming cutout 15 is formed in the cover coating 5 and the resistor element 4 for adjusting the resistance of the resistor element 4 to a predetermined value.

Then, as also shown in FIG. 7, a secondary cover coating 6 is formed by depositing a Glass paste in a screen printing method to cover each primary cover coating 5, and the secondary cover coating 6 is cured by baking. For simplification of the coating step, the secondary cover coating 6 is rendered continuous with respect to each column of substrate chips 2.

Figure 8:
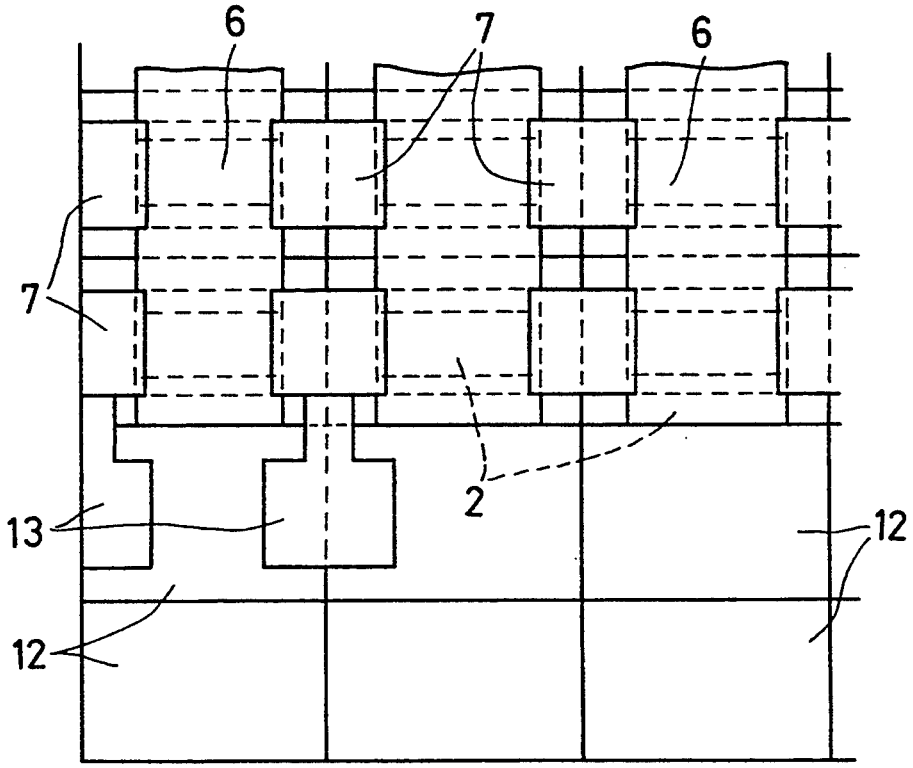
FIG. 8 is a fragmentary plan view showing a method step of forming top auxiliary electrodes.

Then, as shown in FIG. 8, a top auxiliary electrode 7 is formed by depositing a suitable conductive paste in a screen printing method to cover each main electrode 3. As already described, the width of the auxiliary electrode 7 is smaller than that of each substrate chip 2.

Figure 9:
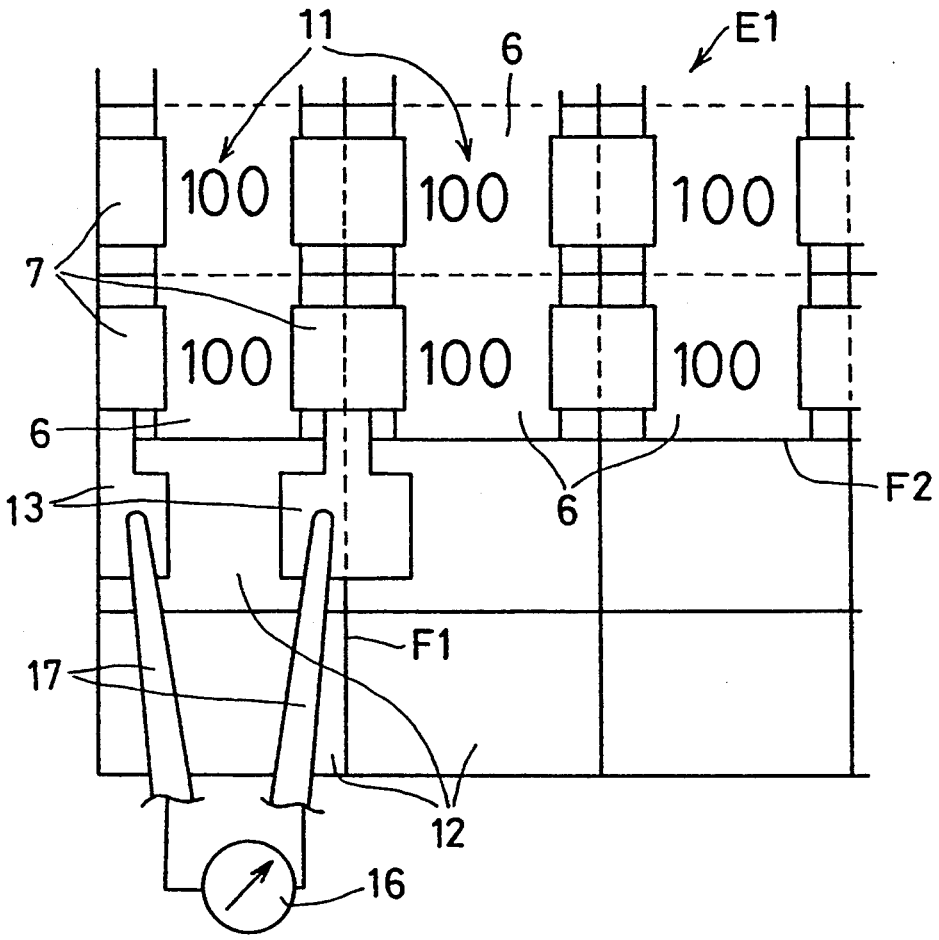
FIG. 9 is a fragmentary plan view showing a method step of providing an resistance indication.

Then, the resistance is measured with respect to the resistor element 4 of a representative substrate chip 2 which is connected to the pair of dummy electrodes 13. Such measurement is performed by bringing probes 17 of a resistance meter 16 into contact with the respective dummy electrodes 13, as shown in FIG. 9. After the resistance measurement, an indication 11 of the measured resistance is printed onto the secondary cover coating 6 with respect to all the substrate chips 2.

It should be appreciated that the resistor elements 4 of all the substrate chips 2 are made to have an equal resistance by the previous adjustment provided by the trimming cutout 15 (FIG. 7). However, due to the absence of the secondary cover coating 6 at that method step, it is impossible to print the adjusted resistance onto the secondary cover coating 6 immediately after the resistance adjustment. Thus, an additional step of reconfirming or redetermining the adjusted resistance is necessary after forming the secondary cover coating 6, but such resistance reconfirmation need be performed only with respect to one resistor element 4 because the other resistor elements 4 are already made to have an equal resistance.

Figure 10A:
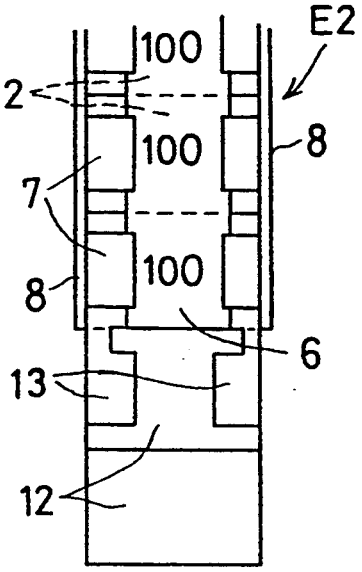
FIGS. 10*a* to 10*c* are views showing successive steps of plating and separating.

In the next method step, the material substrate E1 is divided into substrate columns E2 by breaking at the respective column break lines F1, and end electrodes 8 are formed on the respective longitudinal edges of each substrate column E2 by applying a suitable conductive paste, as shown in FIG. 10*a*. Obviously, each of the end electrodes 8 need extend only up to the dummy chips 12.

Figure 10B:
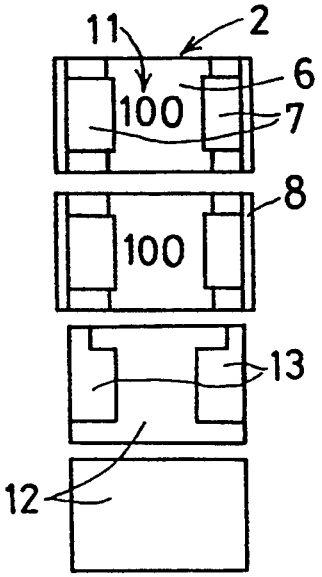
Figure 11:
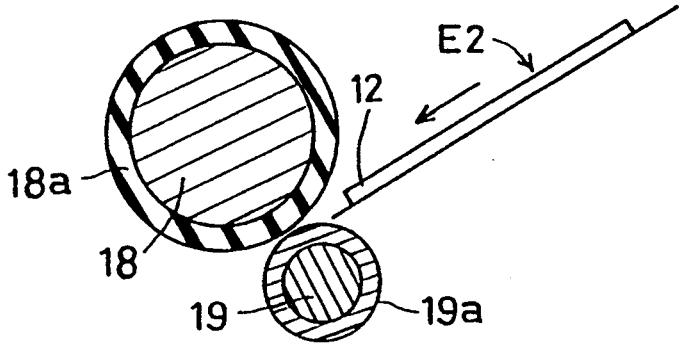
FIG. 11 is a sectional view showing a device for breaking the material substrate.
Figure 12A:
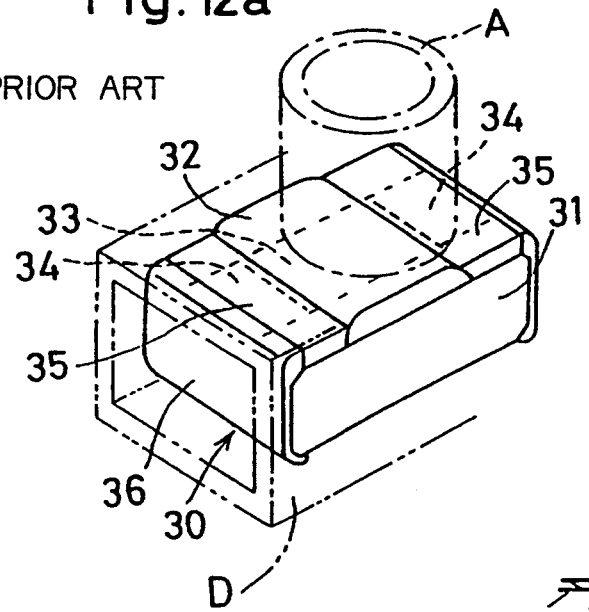
Fig. 12a PRIOR ART
FIGS. 12*a* to 12*c* are views showing a prior art chip resistor.
Figure 12B:
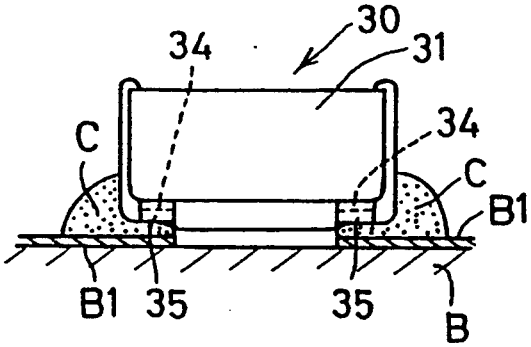
Fig. 12b PRIOR ART
Figure 12C:
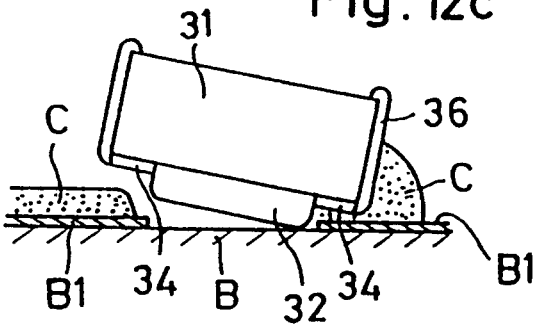

After baking the end electrodes 8 for curing, each substrate column E2 is further divided into individual substrate chips 2 by breaking at the respective row break lines F2, as shown in FIG. 10*b*. This breaking step may be advantageously performed by using such a breaking device as shown in FIG. 11. Specifically, the breaking device comprises a diametrically larger roller 18 having a rubber contact member 18*a*, and a diametrically smaller roller 19 also having a rubber contact member 19a. The substrate column E2 is passed between the respective rollers 18, 19, whereupon the column E2 is bent for breaking at the break lines F2 due to the diametrical difference between these rollers.

Figure 10C:
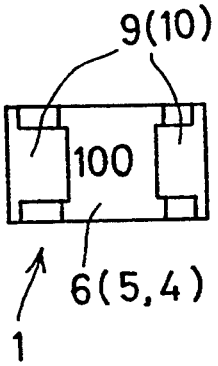

Finally, each substrate chip 2 is subjected to two different plating steps for forming a primary plating 9 made of e.g. nickel and a secondary plating 10 of e.g. solder over the auxiliary and end electrodes 7, 8, as shown in FIG. 10*c*.

According to the method described above, the probes 17 of the resistance meter 16 need only be brought into contact with the dummy electrodes 13 but not the auxiliary electrodes 7. Thus, the product chip resistors 1 are prevented from undergoing a quality deterioration which would be otherwise caused by damaging contact of the probes 17 with the auxiliary electrodes 7.

Further, the width of the main and auxiliary electrodes 3, 7 are smaller than that of the respective substrate chips 2, so that the respective resistor elements 4 are held electrically independent of each other even before dividing at the row break lines F2. Thus, the resistance determination or reconfirmation can be performed after forming the auxiliary electrodes 7 and the secondary cover coating 6, so that it is possible, in determining the final resistance, to take account of a resistance change which would be caused gradually by the successive steps of making the chip resistors.

Moreover, the printing of the indication 11 can be performed very conveniently before dividing the material substrate E1 at the respective break lines F1, F2. Thus, it is possible to avoid erroneous indication printing which might occur when such printing is performed separately after the individual chip resistors are divided.

The present invention being thus described, it is obvious that the same may be varied in many other ways. For instance, the method according to the present invention is applicable for making chip resistors each having a pair of top auxiliary electrodes whose width is substantially equal to that of the substrate chip. Such variations are not to be regarded as a departure from the spirit and scope of the the invention, and all such modifications as would be obvious to those skilled in the art are intended to be included within the scope of the following claims.

I claim:

1. A method of making resistor chips comprising the steps of:

preparing a material substrate having a plurality of column break lines and a plurality of row break lines for providing a plurality of substrate chips and at least one row of dummy chips;

forming a spaced pair of main electrodes on each of the substrate chips;

forming a resistor element on said each substrate chip to bridge between said pair of main electrodes, the resistor element of said each substrate chip being electrically independent of the resistor element of any other substrate chip in a same column;

forming a coating means for covering the resistor element of said each substrate chip;

forming a spaced pair of auxiliary electrodes on said pair of main electrodes;

dividing the material substrate into substrate columns by breaking at the column break lines, each of the substrate columns having an opposite pair of longitudinal edges;

forming a pair of end electrodes on said pair of longitudinal edges of said each substrate column; and dividing said each substrate column into individual substrate chips by breaking at the row break lines; wherein at the time of forming the main electrodes, a spaced pair of dummy electrodes are formed on a selected one of the dummy chips in conduction with the main electrodes of a representative one of the substrate chips located closest to said selected one of the dummy chips; and before dividing the material substrate into the substrate columns, the resistance of the resistor element of said representative one of the substrate chips is determined by utilizing the pair of dummy electrodes, and a resistance indication is formed on the coating means of said each substrate chip.

2. The method according to claim 1, wherein the resistance of the resistor element of the representative substrate chip is determined by bringing probes of a resistance meter into direct contact with the pair of dummy electrodes.

3. The method according to claim 1, wherein the auxiliary electrodes of said each substrate chip are electrically independent of the auxiliary electrodes of any other substrate chip in a same column, the resistance of the resistor element of the representative substrate chip being determined after forming the auxiliary electrodes of said each substrate chip.

4. The method according to claim 1, wherein the resistance indication is formed by printing.

5. The method according to claim 1, wherein the resistor element of said each substrate chip is formed with a trimming cutout for resistance adjustment.

* * * * *